US012790738B2

(12) United States Patent
Kim et al.

(10) Patent No.: US 12,790,738 B2
(45) Date of Patent: Nov. 10, 2026

(54) CLOTHING TREATMENT APPARATUS

(71) Applicant: LG Electronics Inc., Seoul (KR)

(72) Inventors: Hyojun Kim, Seoul (KR); Jongmin Lee, Seoul (KR); Hongjun Cho, Seoul (KR); Hoon Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 430 days.

(21) Appl. No.: 18/686,325

(22) PCT Filed: Aug. 22, 2022

(86) PCT No.: PCT/KR2022/012525
§ 371 (c)(1),
(2) Date: Feb. 23, 2024

(87) PCT Pub. No.: WO2023/027453
PCT Pub. Date: Mar. 2, 2023

(65) Prior Publication Data

US 2024/0352656 A1 Oct. 24, 2024

(30) Foreign Application Priority Data

Aug. 24, 2021 (KR) ..... 10-2021-0111966

(51) Int. Cl.
*D06F 58/08* (2006.01)
*D06F 58/06* (2006.01)

(52) U.S. Cl.
CPC ..... *D06F 58/08* (2013.01); *D06F 58/06* (2013.01)

(58) Field of Classification Search
CPC ..... D06F 37/40; D06F 58/06; D06F 58/08; D06F 58/20; D06F 58/263; D06F 37/26; D06F 23/02; D06F 33/48; D06F 39/12
See application file for complete search history.

(56) References Cited

U.S. PATENT DOCUMENTS 12,655,568 B2 * 6/2026 An ..... D06F 37/304
2020/0399819 A1 12/2020 Lee et al.
(Continued)

FOREIGN PATENT DOCUMENTS

CN 201125329 Y 10/2008
CN 102628208 A 8/2012
(Continued)

OTHER PUBLICATIONS

Notice of Allowance in Chinese Appln. No. 202280058049.5, mailed on Mar. 24, 2026, 7 pages (with English translation).
(Continued)

*Primary Examiner* — David J Laux
(74) *Attorney, Agent, or Firm* — Fish & Richardson P.C.

(57) ABSTRACT

The present application relates to a clothing treatment apparatus comprising: a drum which is provided with a drum body providing a space for storing clothing, a front cover forming the front surface of the drum body, a rear cover forming the rear surface of the drum body, and a rear cover through-hole passing through the rear cover; a fixing panel provided at a position spaced apart from the rear cover; a power transmission unit which is provided with a housing fixed to the fixing panel, an input shaft of which one end is positioned outside the housing and the other end is positioned inside the housing, an output shaft of which one end passes through the fixing panel and is fixed to the rear cover and the other end is positioned inside the housing, and a gear unit positioned inside the housing and transmitting the rotational motion of the input shaft to the output shaft; a motor which is provided with a stator fixed to the fixing panel or the housing and forming a rotating field and a rotor fixed to the one end of the input shaft and rotated by the rotating field; a support panel provided at a position spaced apart from the front cover; an input hole passing through the
(Continued)

support panel; a drum connection body which protrudes from the support panel toward the front cover and is inserted into the drum input hole, and which surrounds the input hole; and a displacement-limiting part which is provided in the drum connection body and limits the displacement of the drum input hole with respect to the radial direction of the input hole.

12 Claims, 14 Drawing Sheets

(56) References Cited

U.S. PATENT DOCUMENTS

| | | | | |
|---|---|---|---|---|
| 2022/0074117 | A1* | 3/2022 | Cho | D06F 37/304 |
| 2022/0098783 | A1* | 3/2022 | Jung | D06F 39/02 |
| 2022/0251758 | A1* | 8/2022 | An | D06F 37/304 |
| 2024/0352655 | A1* | 10/2024 | Cho | D06F 37/40 |
| 2024/0352656 | A1* | 10/2024 | Kim | D06F 58/08 |
| 2024/0376655 | A1* | 11/2024 | An | D06F 37/304 |
| 2026/0132564 | A1* | 5/2026 | Cho | D06F 37/40 |

FOREIGN PATENT DOCUMENTS

| | | | |
|---|---|---|---|
| CN | 106245272 | A | 12/2016 |
| EP | 2749689 | A1 | 7/2014 |
| JP | H09-140990 | | 6/1997 |
| KR | 20-0399777 | Y1 | 10/2005 |
| KR | 10-1163227 | | 11/2006 |
| KR | 10-2009-0119538 | | 11/2009 |
| KR | 10-1708653 | B1 | 2/2017 |
| KR | 10-2019-0101574 | A | 9/2019 |
| KR | 10-2019-0101812 | | 9/2019 |
| KR | 10-2019-0124937 | A | 11/2019 |
| KR | 10-2020-0065932 | A | 6/2020 |
| KR | 10-2020-0066169 | | 6/2020 |
| WO | 2020/111817 | A1 | 6/2020 |

OTHER PUBLICATIONS

Extended European Search Report in European Appln. No. 22861663.7, mailed on Jul. 4, 2025, 5 pages.

Office Action in Korean Appln. No. 10-2021-0111966, mailed on May 22, 2024, 10 pages (with English translation).

International Search Report and Written Opinion in Appln. No. PCT/KR2022/012525, mailed on Dec. 6, 2022, 18 pages (with English translation).

* cited by examiner (b)

(a)

(a)

(b)

CLOTHING TREATMENT APPARATUS

CROSS-REFERENCE TO RELATED APPLICATIONS

This application is a National Stage application under 35 U.S.C. § 371 of International Application No. PCT/KR2022/012525, filed on Aug. 22, 2022, which claims the benefit of Korean Application No. 10-2021-0111966, filed on Aug. 24, 2021. The disclosures of the prior applications are incorporated by reference in their entirety.

TECHNICAL FIELD

The present disclosure relates to a laundry treating apparatus.

BACKGROUND

A laundry treating apparatus is a general term for a washing machine that washes laundry (an object-to-be-washed or dried), a dryer that dries the laundry, and an apparatus that may perform both the washing and the drying of the laundry.

It was common that the washing machine is equipped with a tub in which water is stored, a washing drum that is disposed inside the tub and stores the laundry therein, and a driver (a washing driver) that rotates the washing drum, and the dryer is equipped with a drying drum in which the laundry is stored, a driver (a drying driver) that rotates the drying drum, and a heat exchanger that supplies air to the drying drum to remove moisture from the laundry.

It was common that the washing driver is equipped with a stator that is fixed to the tub and generates a rotating magnetic field, a rotor that rotates by the rotating magnetic field, and a rotation shaft that extends through the tub and connects the washing drum with the rotor, while the drying driver is equipped with a motor, a pulley fixed to a rotation shaft of the motor, and a belt (a power transmitter) that connects a rotating motion of the pulley to the drying drum.

The washing driver is equipped such that the rotation shaft of the motor connects the washing drum with the rotor. To wash or dehydrate the laundry, the washing driver needs to control the number of rotations of the washing drum to be great or change a rotation direction of the washing drum. When the rotation shaft of the motor is constructed to directly connect the washing drum with the rotor, the number of rotations and the rotation direction of the washing drum are able to be easily controlled.

On the other hand, it was common that the existing drying driver has a structure in which the power transmitter such as the belt connects the drying drum with the rotation shaft of the motor. This is because, in the dryer, it is allowed to rotate the drying drum via the power transmitter such as the belt as there is little need to keep the number of rotations of the drying drum great or change a rotation direction of the drying drum. However, when the number of rotations and the rotation direction of the drying drum are able to be changed, a movement of the laundry inside the drying drum will be able to be controlled, so that the dryer is also able to expect a reduction in a drying time and an improved drying performance.

Among the existing dryers, there is one equipped with the drying driver that connects the rotor with the drying drum via a reducer (the power transmitter) (Publication No. 10-2020-0065931). The drying driver is equipped such that an input shaft connected to the rotor and an output shaft connected to the drying drum are coaxial, so that the reduction in the drying time and the improved drying performance may be expected. However, it is difficult to assemble the drying drum with the output shaft of the reducer, and durability reduction of the reducer or the drying drum (a damage to a bolt disposed in the reducer, a damage to the output shaft, a damage to the drying drum, and the like) may occur when assembling the drying drum with the output shaft.

In addition, the existing dryer is able to relatively easily control vibration of a rear surface of the drying drum fixed to the output shaft of the reducer, but separate means are required to control vibration of a front surface of the drying drum where a drum inlet is defined.

SUMMARY

Technical Problem

The present disclosure is to provide a laundry treating apparatus that facilitates assembly of an output shaft of a power transmitter and a drum.

In addition, the present disclosure is to provide a laundry treating apparatus that may prevent durability of a power transmitter and a drum from being deteriorated when the power transmitter and the drum are coupled to each other.

In addition, the present disclosure is to provide a laundry treating apparatus that may minimize a displacement of a drum in a circumferential direction of an output shaft.

Technical Solutions

The present disclosure provides a laundry treating apparatus including a drum including a drum body providing a space for storing laundry therein, a front cover forming a front surface of the drum body, a rear cover forming a rear surface of the drum body, and a rear cover through-hole defined to extend through the rear cover, a fixed panel disposed at a location spaced apart from the rear cover, a power transmitter including a housing fixed to the fixed panel, an input shaft with one end located outside the housing and the other end located inside the housing, an output shaft with one end extending through the fixed panel and fixed to the rear cover and the other end located inside the housing, and a gear unit located inside the housing to transmit a rotating motion of the input shaft to the output shaft, a motor including a stator fixed to the fixed panel or the housing to generate a rotating magnetic field, and a rotor where the one end of the input shaft is fixed and rotated by the rotating magnetic field, a support panel disposed at a location spaced apart from the front cover, an inlet defined to extend through the support panel, a drum connecting body protruding from the support panel toward the front cover, inserted into a drum inlet, and surrounding the inlet, and a displacement limiter disposed on the drum connecting body to limit a displacement of the drum inlet with respect to a radial direction of the inlet.

The displacement limiter may be formed as a protrusion protruding from the drum connecting body toward the drum inlet.

The displacement limiter may include a first limiter and a second limiter spaced apart from each other by 180 degrees around the inlet.

The displacement limiter may include a first limiter, a second limiter, and a third limiter spaced apart from each other by 120 degrees around the inlet.

One of the first limiter, the second limiter, and the third limiter may be disposed to be in contact with an uppermost end of the drum inlet.

The first limiter, the second limiter, and the third limiter may be made of the same material as the support panel.

The front cover may be made of metal, and the displacement limiter may be made of a material with a hardness lower than a hardness of the front cover.

The displacement limiter may be formed as a protrusion protruding from the drum inlet toward the drum connecting body.

The laundry treating apparatus may further include a mounting groove defined in the support panel and defined as a ring-shaped groove surrounding the drum connecting body, and a seal disposed in the mounting groove and in contact with an edge of the drum inlet.

The seal may include a damper fixed to the mounting groove, and a ring-shaped sealing body fixed to the damper and in contact with the edge of the drum inlet.

The displacement limiter may be formed as a felt fixed to the drum connecting body and located between a circumferential surface of the drum connecting body and the drum inlet.

The sealing body and the displacement limiter may be made of the same material.

Advantageous Effects

The present disclosure provides the laundry treating apparatus that facilitates the assembly of the output shaft of the power transmitter and the drum.

In addition, the present disclosure provides the laundry treating apparatus that may prevent the durability of the power transmitter and the drum from being deteriorated when the power transmitter and the drum are coupled to each other.

In addition, the present disclosure provides the laundry treating apparatus that may minimize the displacement of the drum in the circumferential direction of the output shaft.

DETAILED DESCRIPTION

Hereinafter, an embodiment of a laundry treating apparatus will be described in detail with reference to the attached drawings.

Figure 1:
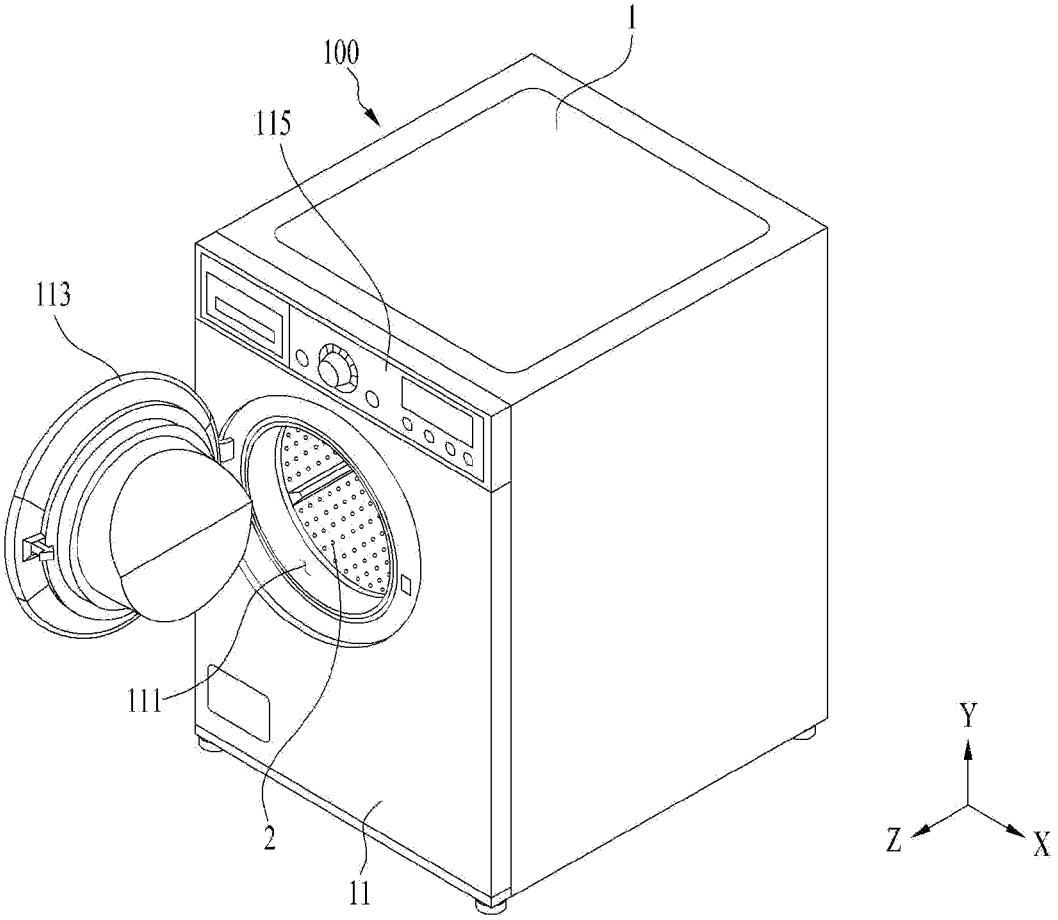
FIG. 1 shows an example of a laundry treating apparatus.
Figure 2:
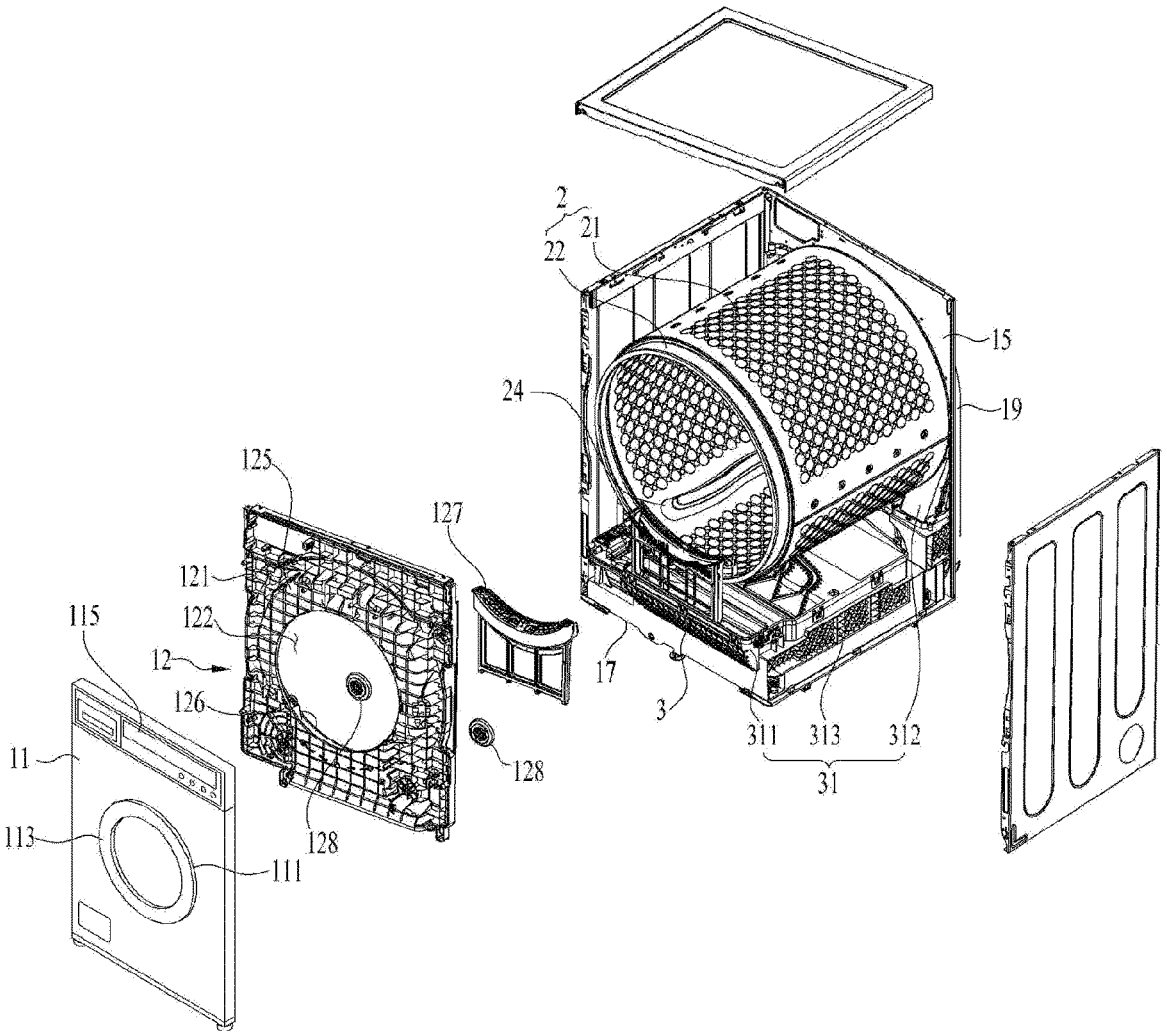
FIG. 2 shows a structure of a cabinet and an example of a support panel.

FIG. 1 shows an example of a laundry treating apparatus 100. The laundry treating apparatus 100 may include a cabinet 1 and a drum 2 that is rotatably disposed inside the cabinet and provides a space in which laundry (an object-to-be-washed or an object-to-be-dried) is stored. As shown in FIG. 2, inside the cabinet 1, a dryer 3 that supplies high-temperature dry air (air with a temperature higher than a room temperature and air with a dryness higher than that of indoor air) to the drum 2 and removes moisture from the laundry may be disposed.

As shown in FIG. 2, the cabinet 1 includes a front panel 11 constituting a front surface of the laundry treating apparatus, and a base panel 17 constituting a bottom surface of the laundry treating apparatus. The front panel 11 has an inlet 111 defined therein that is in communication with the drum 2, and the inlet 111 is able to be closed by a door 113.

The front panel 11 has a control panel 115, which may include an input unit that receives a control command from a user and a display that outputs information such as a control command selectable by the user. The input unit may include a power supply request unit that requests power supply to the laundry treating apparatus, a course input unit that allows the user to select a desired course among multiple courses, and an execution request unit that requests start of the course selected by the user.

Figure 3:
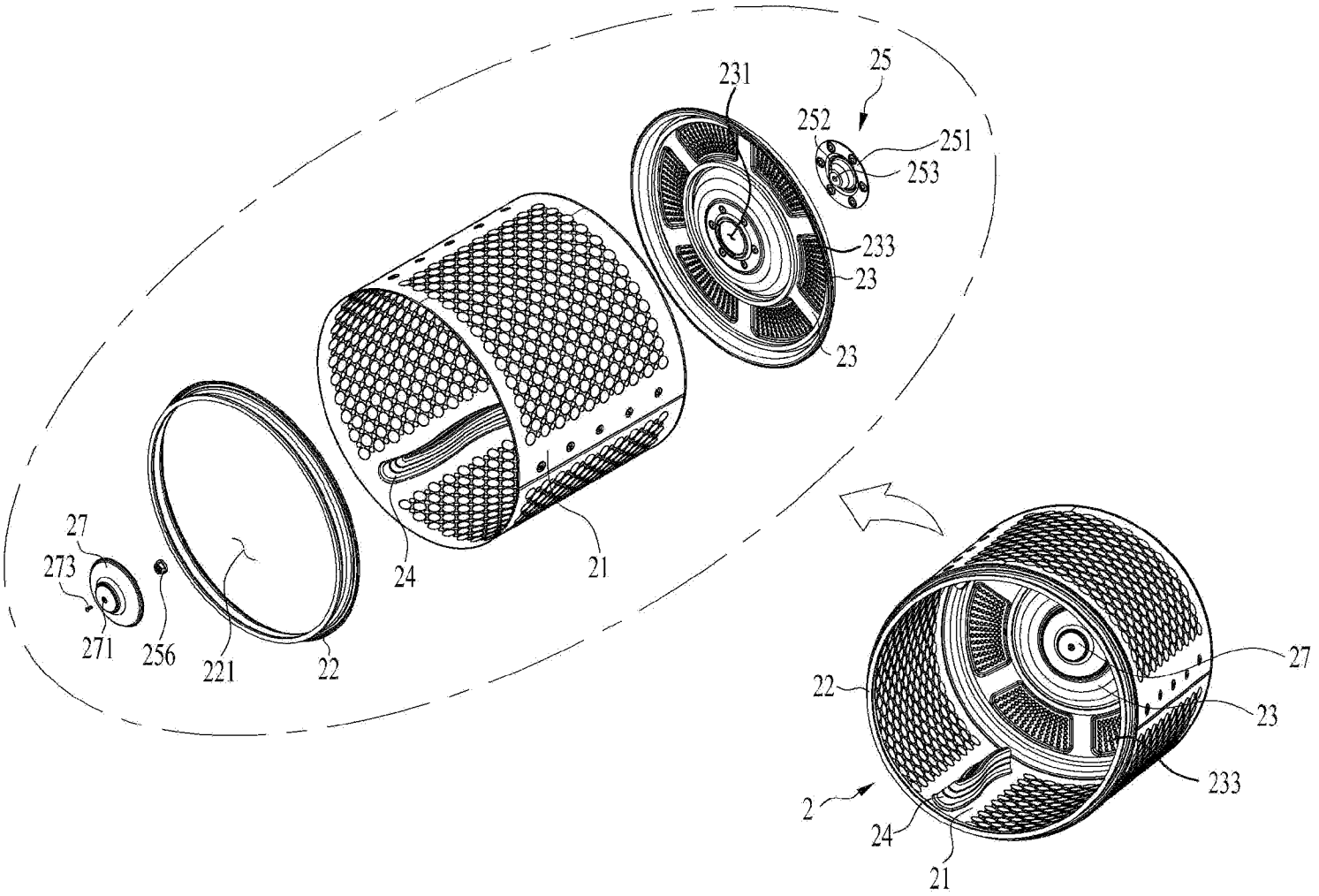
FIG. 3 shows an example of a drum.

The drum 2 may be formed in a hollow cylindrical shape. As shown in FIG. 3, the drum 2 may be formed to include a cylindrical drum body 21 with open front and rear surfaces, a front cover 22 that forms a front surface of the drum body 21, and a rear cover 23 that forms a rear surface of the drum body 21.

The front cover 22 may have a drum inlet 221 that allows the inside of the drum body 21 to be in communication with the outside, and the rear cover 23 may have an air inlet 233 that introduces outside air into the drum body 21.

The drum body 21 may further have a lifter 24. The lifter 24 is means of causing the laundry to repeatedly ascend and descend inside the drum. The lifter 24 may be formed such that a board extending from the front cover 22 toward the rear cover 23 protrudes from the drum body 21 toward a center of rotation of the drum 2 (protrudes from a circumferential surface of the drum toward the center of rotation of the drum).

When the laundry treating apparatus 100 is constructed as an apparatus only for drying the laundry, the drum 2 does not have to include drum through-holes that are defined to extend through the drum body 21 to allow the inside of the drum to be in communication with the outside of the drum.

Figure 4:
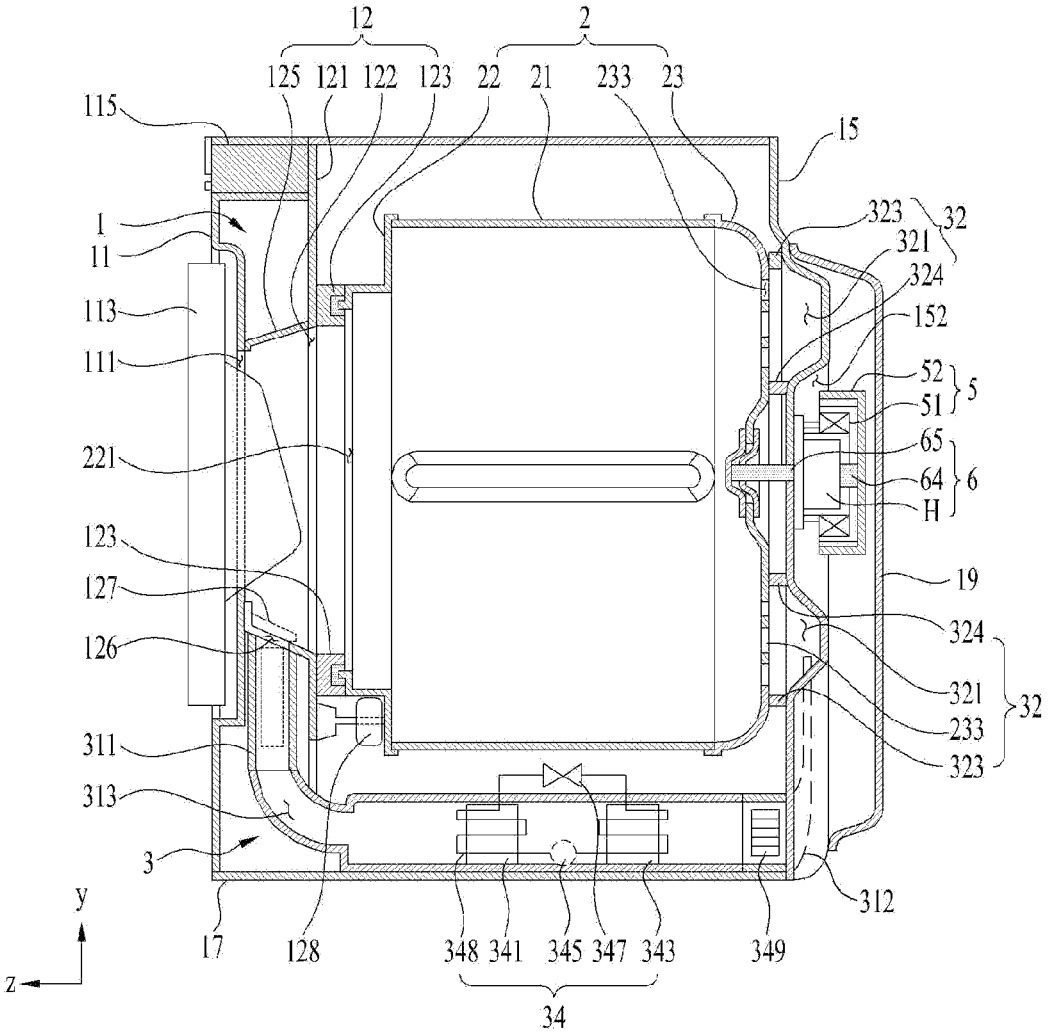
FIG. 4 shows an example of a dryer.

As shown in FIG. 4, the above-described drum 2 may be rotatably fixed to at least one of a first body support 12 and a second body support 15. FIG. 4 shows a case in which the rear cover 23 is rotatably fixed to the second body support 15 via a power transmitter 6, which will be described later, and the front cover 22 is rotatably connected to the first body support 12 as an example.

The first body support 12 may be constructed as a support panel 121 fixed to the cabinet 1 and located between the front panel 11 and the front cover 22. The support panel 121 may be positioned between the front panel 11 and the front cover 22 by being fixed to the base panel 17. In this case, a rear surface (a surface facing the support panel) of the front panel 11 may be fixed to the support panel 121, and a lower end of the front panel 11 may be fixed to the base panel 17.

The support panel 121 may include a support panel through-hole 122, a drum connecting body 123 that connects the support panel through-hole 122 with the drum inlet 221, and a panel connecting body 125 that connects the support panel through-hole 122 with the inlet 111. The support panel through-hole 122 is defined to extend through the support panel 121 and allows the inlet 111 and the drum inlet 221 to be in communication with each other.

The drum connecting body 123 may be formed as a pipe fixed to a rear surface of the support panel 121 (a surface facing the drum inlet in a space provided by the support panel). One end of the drum connecting body 123 may surround the support panel through-hole 122, and a free end of the drum connecting body 123 may support the front cover 22. That is, the free end of the drum connecting body 123 may be inserted into the drum inlet 221, or may be in contact with a free end of the front cover 22 (an edge of the drum inlet) defining the drum inlet 221. FIG. 4 shows a case in which the free end of the drum connecting body 123 is in contact with the free end of the front cover 22 as an example.

The panel connecting body 125 may be formed as a pipe fixed to a front surface of the support panel 121 (a surface facing the front panel in the space provided by the support panel). One end of the panel connecting body 125 may surround the support panel through-hole 122, and the other end of the panel connecting body 125 may be connected to the inlet 111. Accordingly, the laundry supplied into the inlet 111 may move to the drum body 21 via the panel connecting body 125, the support panel through-hole 122, the drum connecting body 123, and the drum inlet 221.

The support panel 121 may have an exhaust port 126 that discharges air inside the drum 2 to the outside of the drum, and a filter 127 may be detachably fixed to the exhaust port 126. The filter 127 may have any structure as long as it may filter foreign substances from air flowing from the drum 2 to the exhaust port 126.

The support panel 121 may further include a drum support 128 that prevents the drum 2 from sagging. The drum support may be formed as a roller that is fixed to the support panel 121 and rotatably supports the drum 2. FIG. 4 shows a case in which the drum support 128 supports the front cover 22, but the drum support 128 may support a circumferential surface of the drum body 21.

Figure 5:
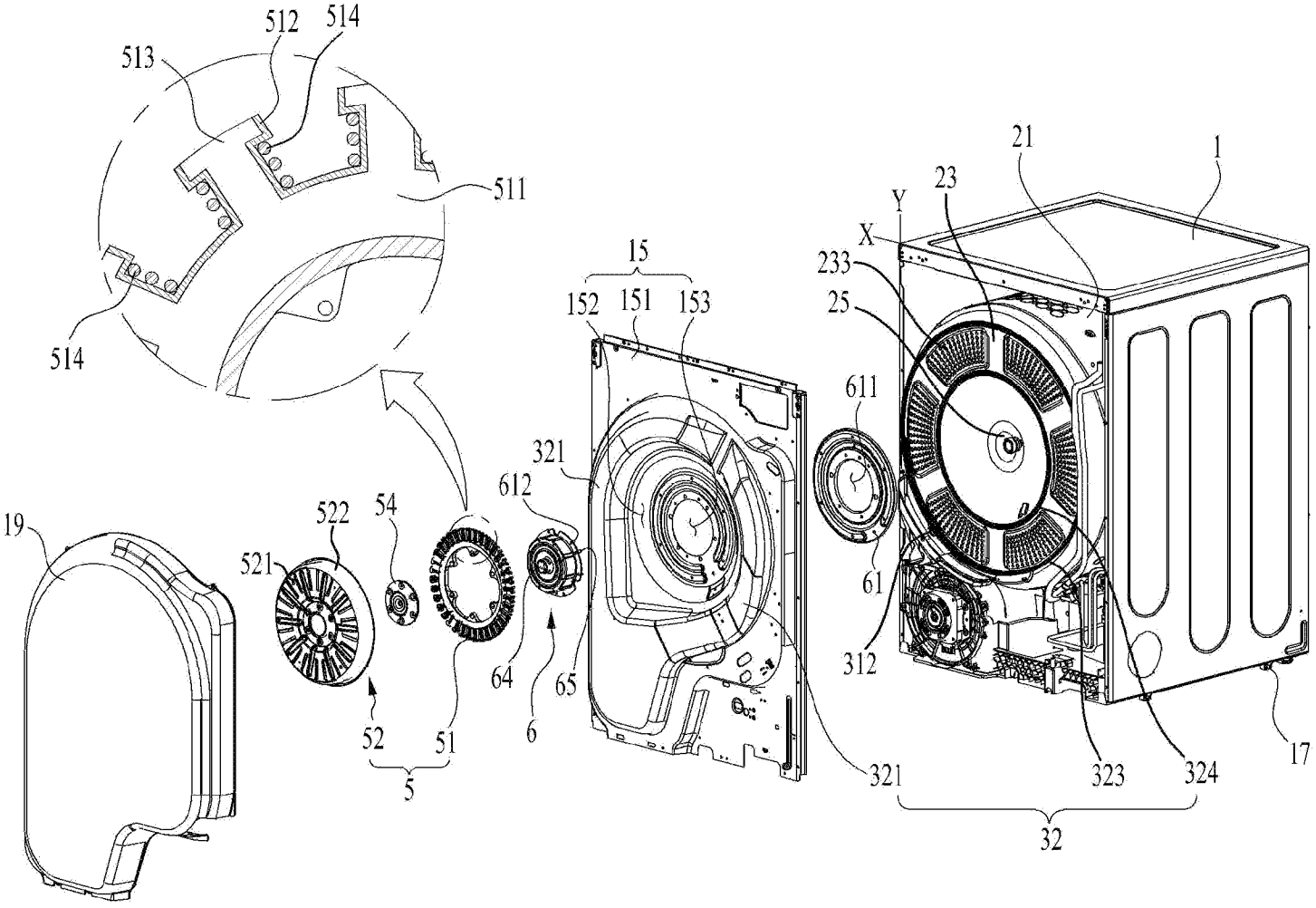
FIG. 5 shows an example of a fixed panel.

The second body support 15 may be formed as a fixed panel 151 fixed to the cabinet 1 so as to be located at a point spaced apart from the rear cover 23. FIG. 5 shows a case in which the fixed panel 151 is fixed to the base panel 17 to form a rear surface of the laundry treating apparatus 100 (a rear surface of the cabinet) as an example.

The fixed panel 151 may have a driver mounting groove 152 defined therein that provides a space for a motor 5 to be mounted. The driver mounting groove 152 may be defined as a groove in which the fixed panel 151 is bent concavely toward the rear cover 23 of the drum. The fixed panel 151 has a fixed panel through-hole 153 through which a shaft (an output shaft) that rotates the drum 2 extends. The fixed panel through-hole 153 may be located inside the driver mounting groove 152.

As described above, when the drum 2 has the drum body 21, the front cover 22 fixed to the drum body, and the rear cover 23 fixed to the drum body, rigidity of the drum increases compared to a structure in which the open front surface and rear surface of the drum body 21 are rotatably connected to the support panel 121 and the fixed panel 151, respectively. As the rigidity of the drum increases, deformation of the drum body 21 may be minimized when the drum rotates, which may minimize a problem in which the laundry is caught in a space between the drum body and the support panel and a space between the drum body and the fixed panel when the drum body 21 is deformed (a load of the motor may be minimized).

As shown in FIG. 4, the dryer 3 may include an exhaust passage 31 connected to the exhaust port 126, a supply passage 32 that guides air supplied from the exhaust passage 31 to the drum body 21, and a heat exchanger 34 disposed inside the exhaust passage 31 to sequentially dehumidify and heat air.

The exhaust passage 31 may include a first duct 311 connected to the exhaust port 126, a second duct 312 connected to the supply passage 32, and a third duct 313 that connects the first duct 311 with the second duct 312. The third duct 313 may be fixed to the base panel 17.

The heat exchanger 34 may be constructed as various apparatuses that may sequentially dehumidify and heat air flowed into the exhaust passage 31. FIG. 4 shows a case in which the heat exchanger 34 is constructed as a heat pump as an example. That is, the heat exchanger 34 includes a first heat exchanging apparatus (a heat absorber) 341 that removes moisture from air introduced into the exhaust passage 31, a second heat exchanging apparatus (a heater) 343 that is disposed inside the exhaust passage 31 and heats air that has passed through the heat absorber 341, and a fan 349 that causes air discharged from the drum 2 to sequentially pass through the heat absorber and the heater and then move to a supply duct 32.

The heat absorber 341 and the heater 343 are sequentially arranged along a flow direction of air and are connected to each other via a refrigerant pipe 348 that forms a circulation path for a refrigerant. The refrigerant flows along the refrigerant pipe 348 by a compressor 345 located outside the exhaust passage 31, and the refrigerant pipe 348 has a pressure regulator 347 that regulates a pressure of the refrigerant.

As shown in FIG. 5, the air inlet 233 defined in the rear cover 23 of the drum may be defined as multiple holes are arranged to surround a center of the rear cover 23 (the center of rotation of the drum). In this case, the supply passage 32 may include a supply duct 321 disposed on the fixed panel 151 to form a flow path of air discharged from the second duct 312, and a first flow path forming portion 323 and a second flow path forming portion 324 that guide air inside the supply duct 321 to the air inlet 233.

The supply duct 321 may form the flow path (the flow path of air) by bending in a direction in which the fixed panel 151 is away from the rear cover 23. Additionally, the supply duct 321 may be formed in a ring shape surrounding the driver mounting groove 152, and an outlet of the second duct 312 may be connected to a circumferential surface of the supply duct 321.

The first flow path forming portion 323 may be disposed to surround an outer circumferential surface of a ring formed by the air inlets 233 (a circumferential surface with a greater diameter among two circumferential surfaces of the ring), and the second flow path forming portion 324 may be disposed to surround an inner circumferential surface of the ring formed by the air inlets 233 (a circumferential surface with a smaller diameter among the two circumferential surfaces of the ring).

The first flow path forming portion 323 and the second flow path forming portion 324 may be fixed to the rear cover 23 or to the supply duct 321. FIG. 5 shows a case in which the flow path forming portions 323 and 324 are fixed to the rear cover 23 as an example.

In FIG. 5, a free end of the first flow path forming portion 323 surrounds the outer circumferential surface of the flow path (the ring-shaped flow path) formed by the supply duct 321, and a free end of the second flow path forming portion 324 surrounds the inner circumferential surface of the flow path formed by the supply duct 321. The first flow path forming portion 323 and the second flow path forming portion 324 may be made of rubber, felt, or the like.

The motor 5 that generates power necessary for the rotation of the drum 2 includes a stator 51 that is located in the driver mounting groove 152 and generates a rotating magnetic field, and a rotor 52 that rotates by the rotating magnetic field. The rotating motion of the rotor 52 is transmitted to the drum 2 via the power transmitter 6 fixed to the fixed panel 151, and the stator 51 is fixed to at least one of the fixed panel 151 or the power transmitter 6.

When the stator 51 is fixed to the power transmitter 6, there is an advantageous effect in maintaining coaxiality of an input shaft 64 and an output shaft 65 disposed in the power transmitter 6 (when the drum rotates, vibration of the laundry treating apparatus may be minimized and deterioration of durability of the power transmitter may be minimized).

To prevent the motor 5 located in the driver mounting groove 152 from being exposed to the outside (to improve durability of the motor and prevent safety accidents by preventing exposure of the motor to an external environment), the fixed panel 151 may further include a cover panel 19 that prevents the motor 5 from being exposed to the outside. Furthermore, the cover panel 19 may be formed in a shape that may also prevent the supply duct 321 from being exposed to the outside (a shape that surrounds the supply duct). This is not only to minimize heat escaping to the outside of the supply duct 321, but also to prevent safety accidents that may occur when a body comes into contact with the supply duct 321.

The stator 51 includes a ring-shaped core 511 with a through-hole (a core through-hole) defined at a center thereof, multiple support bars 513 radially protruding from an outer circumferential surface of the core 511, an insulator 512 that insulates the core and the support bar, and a coil 514 disposed to surround the support bar 513.

The rotor 52 may include a disk-shaped rotor body 521, a rotor circumferential surface 522 that extends from an edge of the rotor body 521 toward the fixed panel 515 to define a space in which the stator 51 is accommodated, and multiple permanent magnets 523 fixed to the rotor circumferential surface 522 such that N and S poles are alternately exposed.

Figure 6:
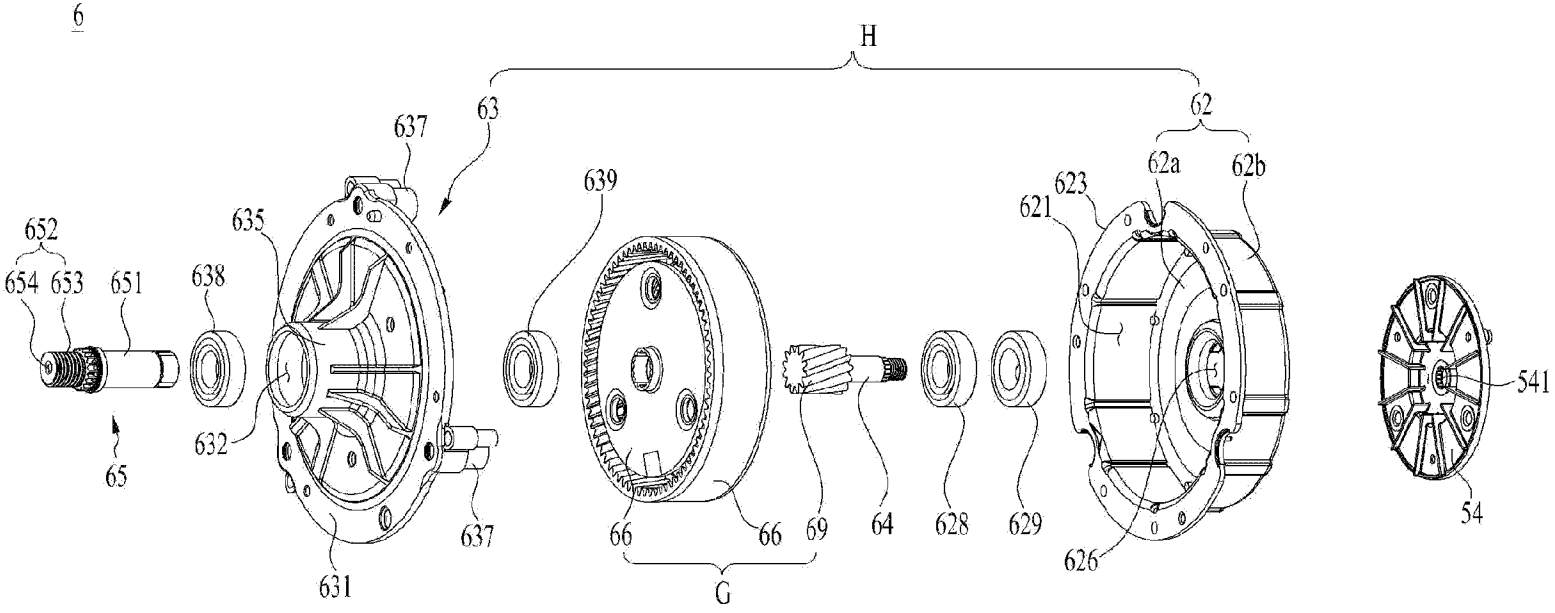
FIGS. 6 and 7 show an example of a power transmitter.

FIG. 6 shows an example of the power transmitter 6 that connects the rotor 52 with the rear cover 23 of the drum.

The power transmitter 6 includes a housing H fixed to the fixed panel 151, an input shaft 64 rotatably fixed to a bottom surface (a surface facing a direction in which the rotor is located) of the housing H, an output shaft 65 rotatably fixed to a top surface (a surface facing a direction in which the fixed panel is located) of the housing H, and a gear unit G that is disposed inside the housing and transmits the rotating motion of the input shaft 64 to the output shaft 65.

The input shaft 64 may have one end fixed to the rotor 52 and the other end formed as a shaft located inside the housing H, and the output shaft 65 may have one end fixed to the rear cover 23 and the other end formed as a shaft located inside the housing H. The gear unit G connects one end of the input shaft 64 located inside the housing H with one end of the output shaft 65 located inside the housing.

The housing H is preferably fixed to the fixed panel 151 and located in a space (outside the cabinet) separated from a space in which the drum 2 is located (inside the cabinet). This is to improve the durability of the power transmitter 6 by minimizing transfer of heat inside the cabinet (heat emitted from the drum or the dryer) to the inside of the housing H.

The input shaft 64 may be coupled to the rotor body 521 via a shaft fixer 54. The shaft fixer 54 may include a shaft fixing hole 543 to which one end of the input shaft 64 is fixed.

The output shaft 65 is inserted into the fixed panel through-hole 153 and connected to the rear cover 23. The rear cover 23 may have a shaft fastening portion 25 to which the output shaft 65 is fixed. This is to distribute a stress acting on the center of the rear cover 23 when the output shaft 65 rotates. A specific structure of the shaft fastening portion 25 will be described later.

To minimize deformation of the fixed panel 151, the housing H may be fixed to the fixed panel 151 via a transmitter bracket 61 and a housing fastener 612.

As shown in FIG. 5, the transmitter bracket 61 may include a bracket through-hole 611 through which the output shaft 65 passes, and the housing fastener 612 may be formed as a bolt that connects the housing H with the transmitter bracket 61. The transmitter bracket 61 may be made of the same material as the fixed panel 151, or may be made of a material with a higher strength than that of the fixed panel 151.

As shown in FIG. 6, the housing H may include a housing body 62 formed in a hollow cylindrical shape and having an open hole defined in a surface facing the fixed panel 151, and a housing cover 63 that is fixed to the housing body 62 and closes the open hole.

The housing body 62 may define an accommodating space 621 in which the gear unit G is mounted. The accommodating space 621 may be formed via a housing base **62*a* on which the input shaft 64 is fixed, and a housing circumferential surface 62*b* extending from an edge of the housing base 62*a* toward the housing cover 63**.

Figure 7:
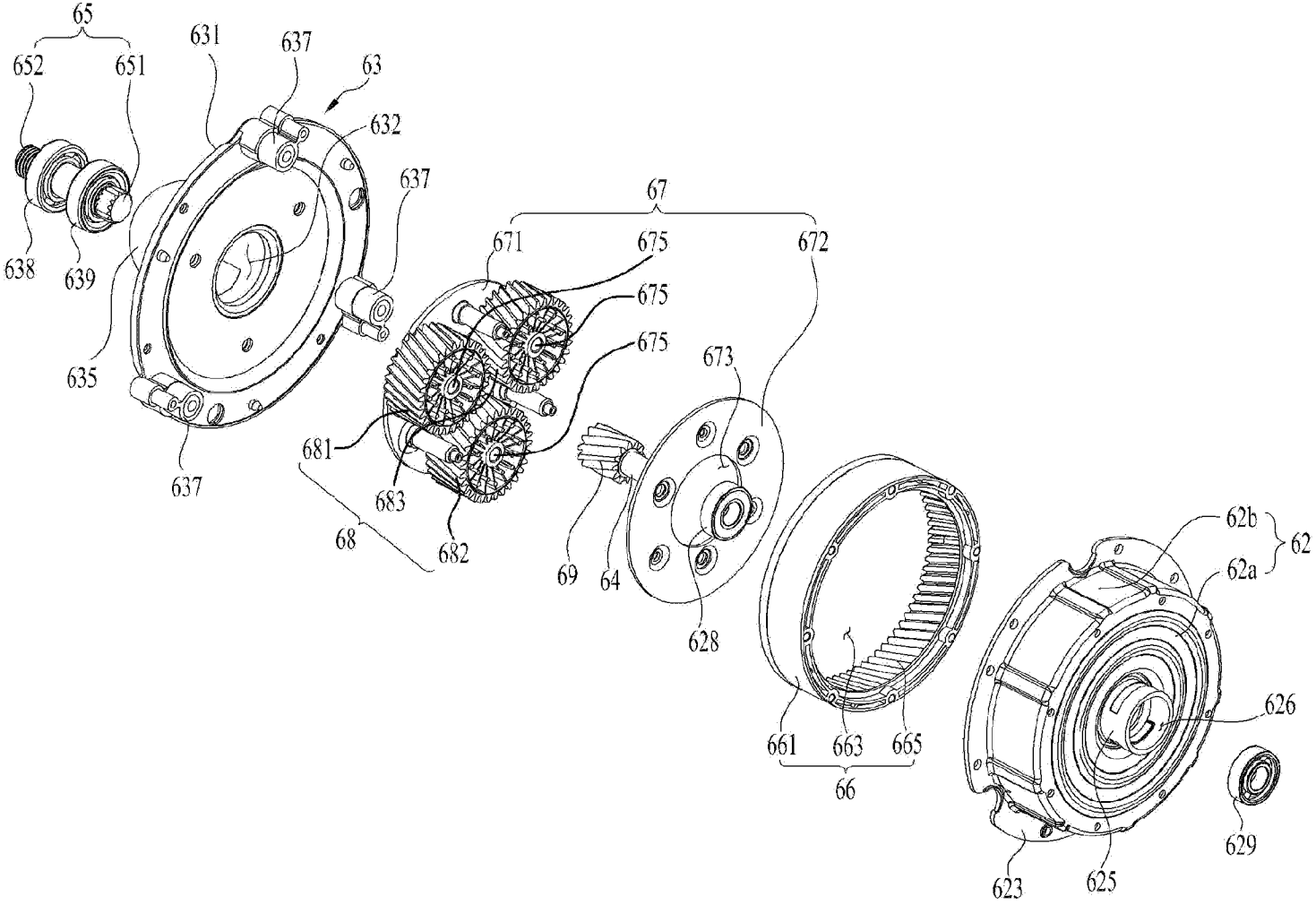

As shown in FIG. 7, the housing body 62 has an input shaft support 625 extending from the housing base **62*a* toward the rotor 52. The input shaft support 625 may be formed as a pipe surrounding an input shaft through-hole 626 extending through the housing body 62**.

The input shaft 64 inserted into the input shaft through-hole 626 is rotatably fixed to the input shaft support 625 via input shaft bearings 628 and 629. The input shaft bearings may include an input shaft first bearing 628 that is fixed to the input shaft support 625, and an input shaft second bearing 629 that is fixed inside the input shaft through-hole 626 and located between the input shaft first bearing 628 and the rotor 52.

The housing cover 63 may be formed in any shape that may open and close the open hole defined in the housing body 62. FIG. 7 shows a case in which the housing cover 63 is formed as a disk-shaped cover body 631 as an example. The housing cover 63 may be fixed to the housing body 62 via a cover fixing plate 623 disposed on the housing circumferential surface **62*b***.

The housing cover 63 may include an output shaft through-hole 632 defined to extend through the cover body 631, and a pipe-shaped output shaft support 635 that extends from the cover body 631 toward the fixed panel 151 and surrounds the output shaft through-hole 632.

The output shaft support 635 may include output shaft bearings 638 and 639 that rotatably fix the output shaft 65 to the output shaft through hole 632.

The output shaft bearing may include an output shaft first bearing 638 and an output shaft second bearing 639 that are fixed to the output shaft support portion 635 and located inside the output shaft through hole 631.

The housing cover 63 has a mounting portion 637 to which the stator 51 is fixed. The mounting portion 637 may include multiple mounting portions along a circumferential surface of the cover body 631, and the stator 51 may be fixed to the housing H via a bolt that connects the insulator 512 with the mounting portion 637.

As previously described, the housing H is fixed to the fixed panel 151 via the housing fastener 612, the stator 51 is fixed to the housing H via the mounting portion 637, and the rotor 52 is fixed to the housing H via the input shaft 64. Because the stator 51 and the rotor 52 are fixed to the housing H (because the stator and rotor vibrate together with the housing), a decrease in the coaxiality of the input shaft 64 and the output shaft 65 may be minimized.

The gear unit G may include a ring gear 66 fixed to the housing circumferential surface 62*b* and located in the accommodating space 621, a driving gear 69 fixed to the input shaft 64 and located inside the accommodating space 621, a cage 67 located inside the accommodating space 622 and to which the other end of the output shaft 65 is fixed, and a driven gear 68 rotatably fixed to the cage 67 to connect the driving gear 69 with the ring gear 66.

The ring gear 66 may include a gear body 661 fixed to the housing circumferential surface 62*b*, a gear body through-hole 663 defined to extend through the gear body, and gear teeth 665 disposed along an inner circumferential surface of the gear body.

The cage 67 may include a first base 671 located inside the gear body through-hole 663 and to which one end of the output shaft 65 is fixed, a second base 672 located inside the gear body through-hole 663 and having a base through-hole 673 defined at a center thereof, and a connecting shaft 675 that connects the first base with the second base and forms a rotation shaft of the driven gear 68. Because the output shaft 65 is fixed to the first base 671, whether the output shaft 65 rotates is determined depending on whether the cage 67 rotates.

The driven gear 68 may be composed of multiple gears rotatably fixed to the connecting shaft 675. In the drawing, a case in which the driven gear is composed of a first driven gear 681, a second driven gear 682, and a third driven gear 683 is shown as an example.

The input shaft 64 is inserted into the base through-hole 673 to be coaxial with the output shaft 65, and gear teeth disposed on the driving gear 69 are located in a space defined between the driven gears and are engaged with gear teeth of the driven gears 681, 682, and 683.

An operation process of the above-described power transmitter 6 is as follows. When the rotor 52 rotates, the input shaft 64 rotates. When the driving gear 69 rotates by the input shaft 64, the driven gears 681, 682, and 683 engaged with the driving gear 69 also rotate. Because the driven gears 681, 682, and 683 are engaged with the ring gear 66 fixed to the housing body 62, when the driven gear 68 rotates, the cage 67 and the output shaft 65 rotate, and thus the drum 2 fixed to the output shaft 65 will also rotate.

As mentioned above, to distribute the stress acting on the center of the rear cover 23 when the output shaft 65 rotates (to minimize a decrease in durability of the rear cover), the output shaft 65 is connected to the rear cover 23 of the drum via the shaft fastening portion 25.

Figure 8:
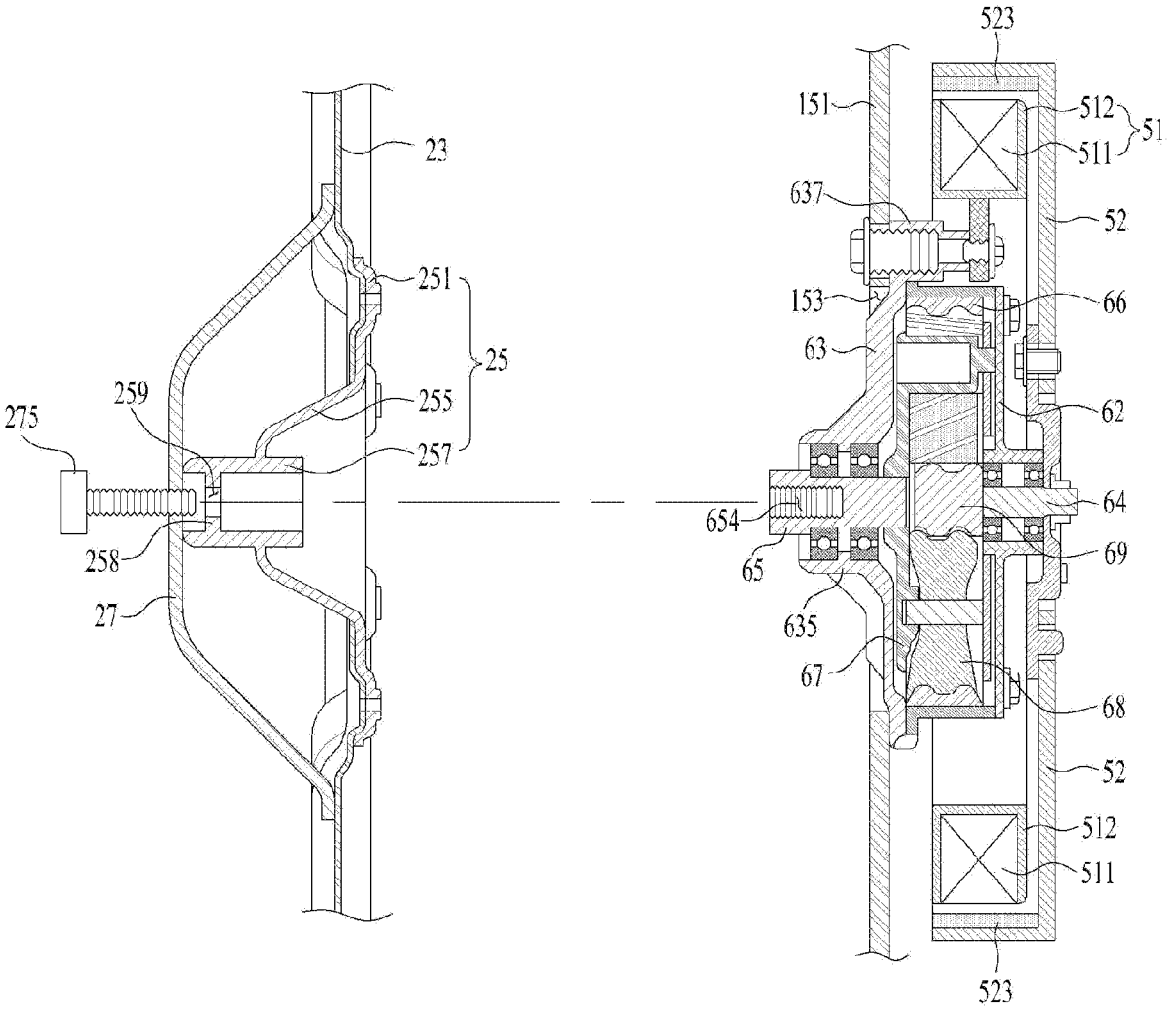
FIG. 8 shows an example of a coupling structure of a drum, a fixed panel, and a power transmitter.

That is, as shown in FIG. 8, the rear cover 23 may have a rear cover through-hole 231, and the shaft fastening portion 25 may be fixed to the rear cover 23 to close the rear cover through-hole 231.

The shaft fastening portion 25 may include a fastening body (a first fastening body) 251 fixed to the rear cover 23, a connecting body 253 extending from the fastening body 251 and inserted into the rear cover through-hole 231, and a fastening pipe 257 fixed to the connecting body 253 and located inside the drum 2.

The fastening pipe 257 may be formed as a pipe into which one end of the output shaft 65 is inserted. Inside the fastening pipe 257, a fixing plate 258 in contact with one end of the output shaft 65 is disposed, and the fixing plate 258 has a fixing plate through-hole 259. The fixing plate through-hole 259 is defined to be connected to a fastening groove 654 defined in the output shaft 65.

In one example, to prevent the fastening pipe 257 from being exposed into the drum (to prevent deterioration of durability of the output shaft), a fastening portion cover 27 may be fixed to the rear cover 23.

The fastening portion cover 27 may be formed in any shape that may not only close the rear cover through-hole 231, but also prevent the shaft fastening portion 25 from being exposed into the drum. FIG. 8 shows an example in which the fastening portion cover 27 is formed in a cone shape.

The fastening portion cover 27 includes a cover through-hole 271 in communication with the fixing plate through-hole 259 and the fastening groove 654. Therefore, when a drum fastener 275 is inserted into the cover through-hole 271 and the fixing plate through-hole 259 and fixed to the fastening groove 654, both the fastening portion cover 27 and the output shaft 65 may be fixed to the shaft fastening portion 25.

To couple the output shaft 65 of the above-described structure with the shaft fastening portion 25, an operator must adjust a location of the drum 2 such that the output shaft 65 is inserted into the fastening pipe 257. Because a diameter of the fastening pipe 257 is small, it takes a long time to insert the output shaft 65 into the fastening pipe 257.

When the output shaft 65 is inserted into the fastening pipe 257, the operator must insert the drum fastener 275 into the cover through-hole 271 and the fixing plate through-hole 259 and then fix the same in the fastening groove 654. That is, to couple the drum fastener 275 to the fastening groove 654, the drum 2 must be maintained mounted on the output shaft 65. When the fixing plate through-hole 259 and the fastening groove 654 are not aligned, an assembly time may increase when fastening the drum fastener 275.

In addition, when the drum 2 is maintained mounted on the output shaft 65, there is a risk that the durability of the power transmitter 6 may be deteriorated. When the drum 2 is mounted on the output shaft 65, an external force resulted from a load of the drum 2 will be transmitted to the output shaft 65 via the fastening pipe 257 and the external force transmitted to the output shaft 65 will be transmitted to the gear unit G in addition to the output shaft bearings 638 and 639.

Figure 9:
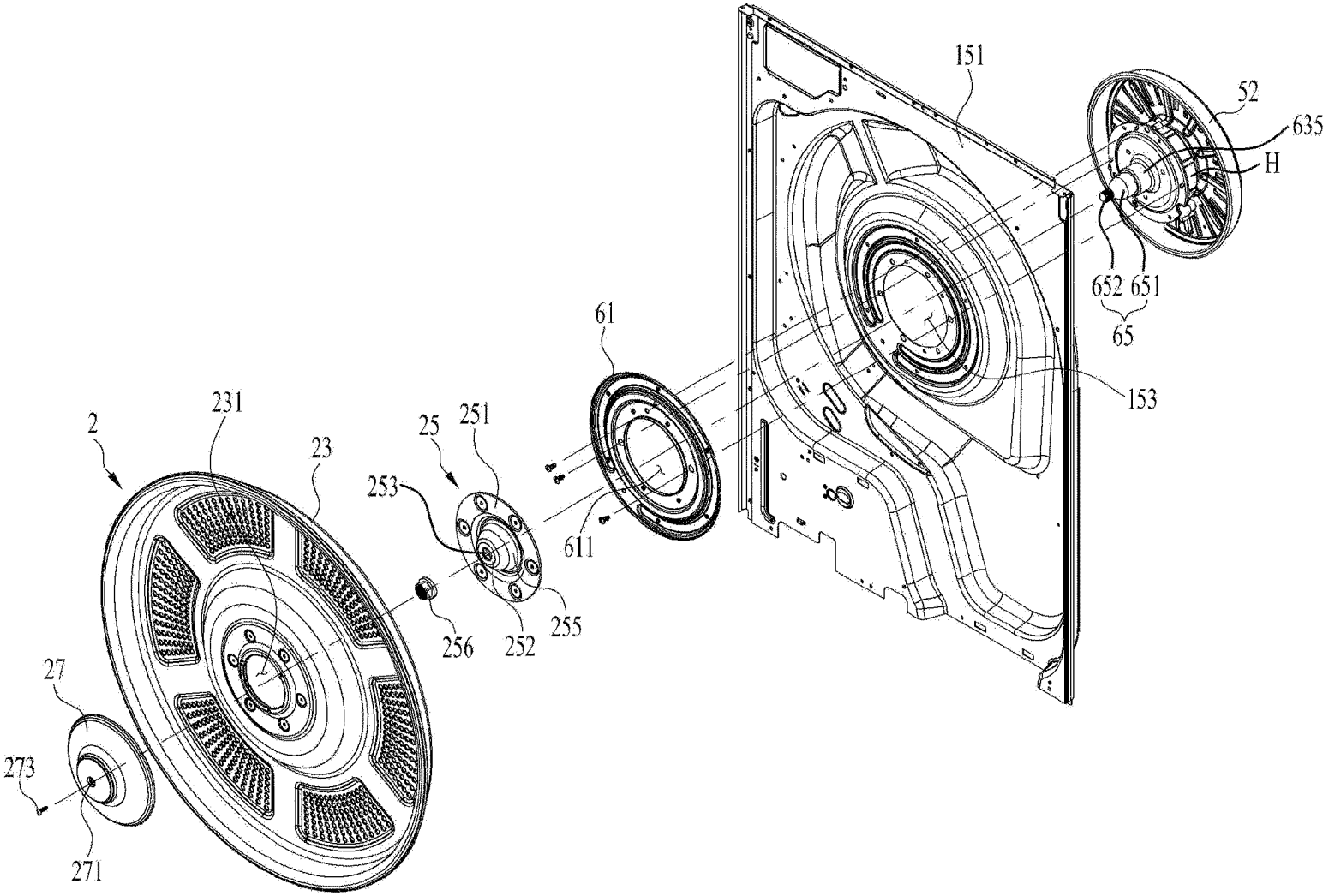
FIGS. 9, 10, and 11 show another embodiment of a coupling structure of a drum and an output shaft.
Figure 10:
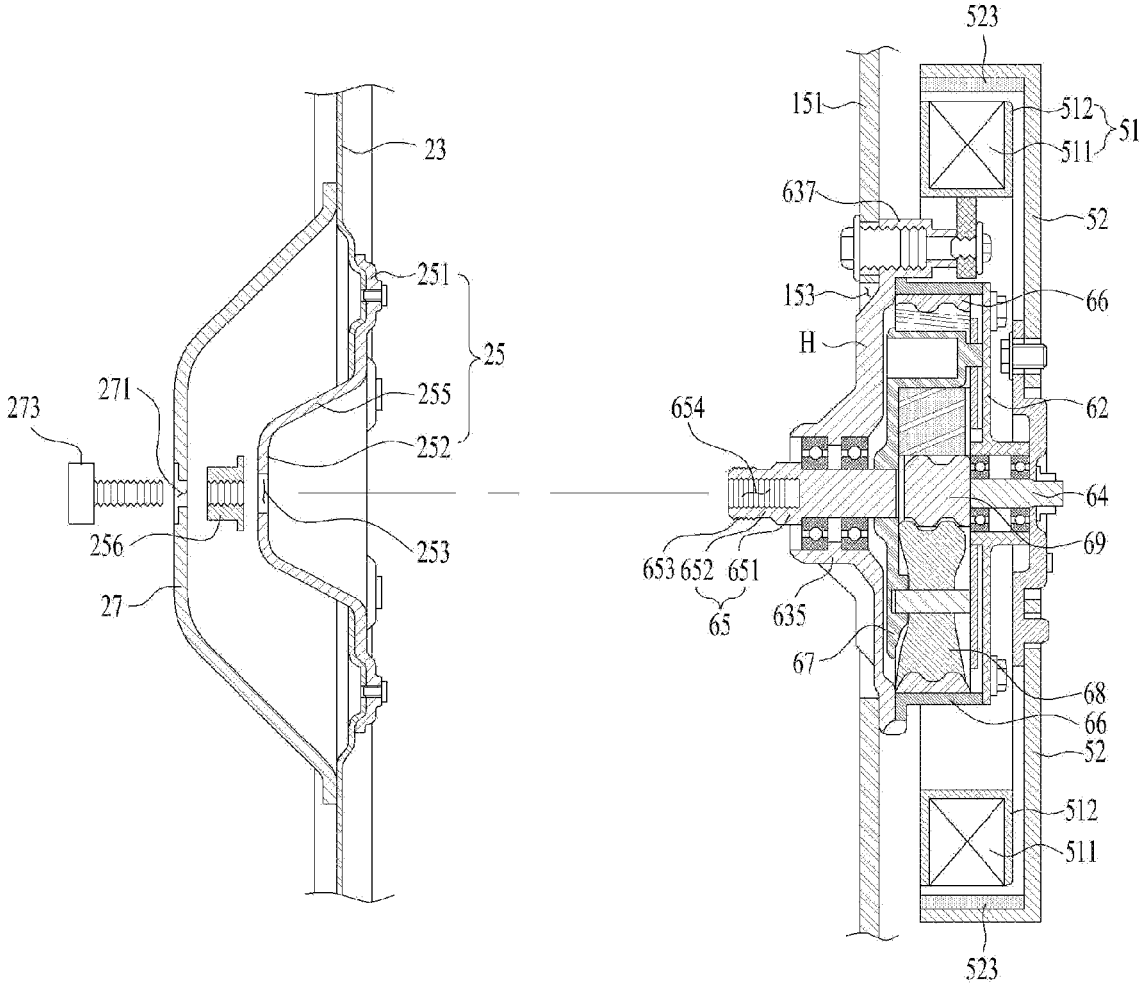

To solve the above-described problem that may occur during the assembly process of the drum and the output shaft, the shaft fastening portion 25 and the output shaft 65 may be formed in structures shown in FIGS. 9 and 10.

The shaft fastening portion 25 in FIG. 9 prevents the deterioration of the durability of the power transmitter 6 by minimizing an amount of external force input to the output shaft 65, and shortens the assembly time by coupling the output shaft 65 with the shaft fastening portion 25 via a nut 256.

The shaft fastening portion 25 according to the present embodiment may include the first fastening body 251 fixed to the rear cover 23, a connecting body 255 extending from the first fastening body 251 and inserted into the rear cover through-hole 231, and a second fastening body 252 fixed to the connecting body 255 and located inside the drum 2. The second fastening body 252 includes a fastening portion through-hole 253 defined therein into which the output shaft 65 is inserted.

As shown in FIG. 10, the output shaft 65 includes a fastening shaft 651 located inside the housing H and fixed to the cage 67, and a fixed shaft 652 extending from the fastening shaft 651 and inserted into the fastening portion through-hole 253.

A screw thread 653 is disposed on a circumferential surface of the fixed shaft 652. Accordingly, the nut 256 is coupled to one end 652 of the output shaft that has passed through the fastening portion through-hole 253 to fix the output shaft 65 and the shaft fastening portion 25 to each other.

Assembly of the drum 2 and the output shaft 65 is performed via a process of fixing the fixed panel 151 on which the power transmitter 6 is mounted to the base panel 17, a process of inserting the output shaft 65 into the fastening portion through-hole 253, a process of fixing a location of the front cover 22 by fixing the support panel 121 to the base panel 17, and a process of coupling the output shaft 65 with the shaft fastening portion 25 via the nut 256.

Before fixing the support panel 121 to the base panel 17, the output shaft 65 is maintained inserted into the fastening portion through-hole 253. However, the present embodiment may maintain a greater inclination angle of the drum compared to the embodiment with the fastening pipe 257. That is, in the embodiment in FIG. 8, the front cover 22 of the drum is not able to be seated on a top surface of the exhaust passage 31, the base panel 17, or the like because of the fastening pipe 257, whereas in the present embodiment, the front cover 22 may be maintained seated on the top surface of the exhaust passage 31, the base panel 17, or the like. Therefore, the laundry treating apparatus equipped with the shaft fastening portion 25 shown in FIG. 10 may minimize the deterioration of the durability of the power transmitter 6.

In one example, a diameter of the connecting body 255 in the present embodiment decreases in a direction from the first fastening body 251 to the second fastening body 252. When the shape of the connecting body 255 is as described above, the fixed shaft 652 will be guided along a surface of the connecting body 255 into the fastening portion through-hole 253. Therefore, the present embodiment may shorten the time of inserting the fixed shaft 652 into the fastening portion through-hole 253.

To firmly couple the shaft fastening portion 25 with the output shaft 65, the shaft fastening portion 25 may have a fastening portion serration, and the output shaft 65 may further have an output shaft serration.

Figure 11:
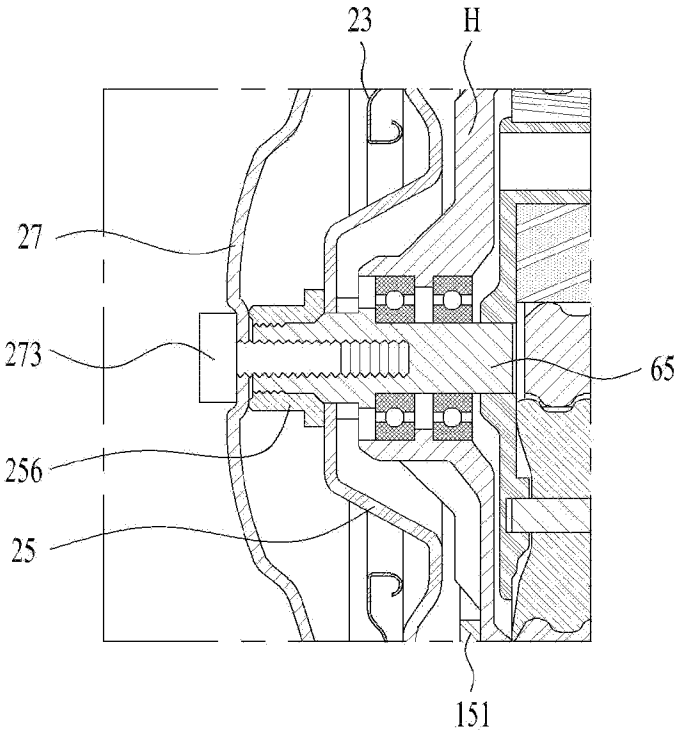
Figure 11:
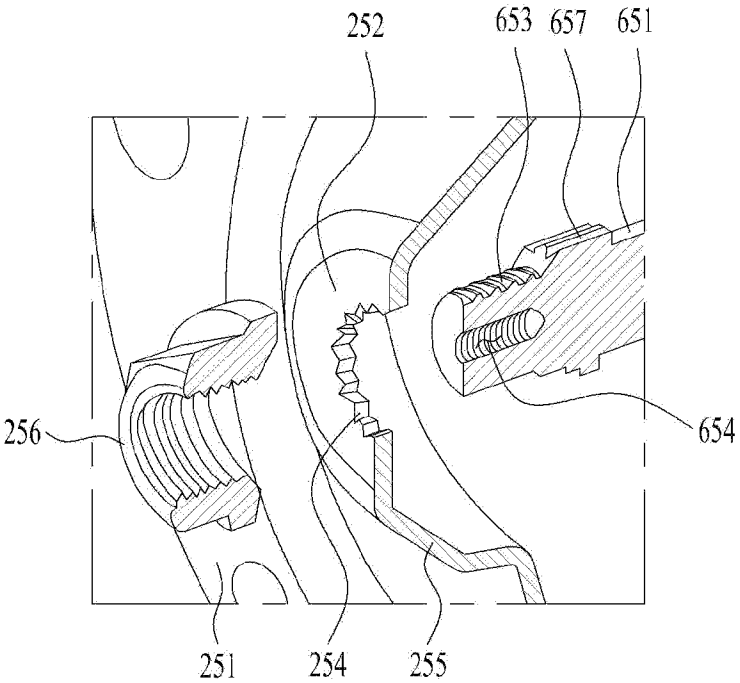

As shown in FIG. 11, the fastening portion serration 254 may be formed as a protrusion protruding from an edge of the fastening portion through-hole 253 toward a center of the fastening portion through-hole 253, and the output shaft serration 657 may be defined as a groove defined in a circumferential surface of the fastening shaft 651 and coupled to the fastening portion serration 254.

To facilitate the coupling of the fastening portion serration 254 and the output shaft serration 657, the output shaft 65 may further include an inclined surface 655 that connects the fastening shaft 651 with the fixed shaft 652 and guides the fastening portion serration 254 to the output shaft serration 657.

That is, a diameter of the fastening shaft 651 may be set to be equal to a diameter of the fastening portion through-hole 253, a diameter of the fixed shaft 652 may be set to be smaller than the diameter of the fastening shaft 651, and the inclined surface 655 may connect a circumferential surface of the fixed shaft 652 with a circumferential surface of the fastening shaft 651.

To prevent the above-described shaft fastening portion 25 from being exposed into the drum 2, the present embodiment may also further include the fastening portion cover 27. The fastening portion cover 27 may be formed in any shape that may close the rear cover through-hole 231 and prevent the exposure of the shaft fastening portion 25.

As shown in FIG. 10, the fastening portion cover 27 may be fixed to the output shaft 65 by a bolt 273 that is inserted into the cover through-hole 271 and fixed to the fastening groove 654 of the fixed shaft 652.

In the laundry treating apparatus 100 having the above-described structure, there is a possibility that air supplied to the drum 2 via the dryer 3 is discharged to the outside of the drum via the drum inlet 221. To minimize such disadvantage, the laundry treating apparatus 100 may further include a seal 7 that minimizes air leakage via the drum inlet 221.

Figure 12:
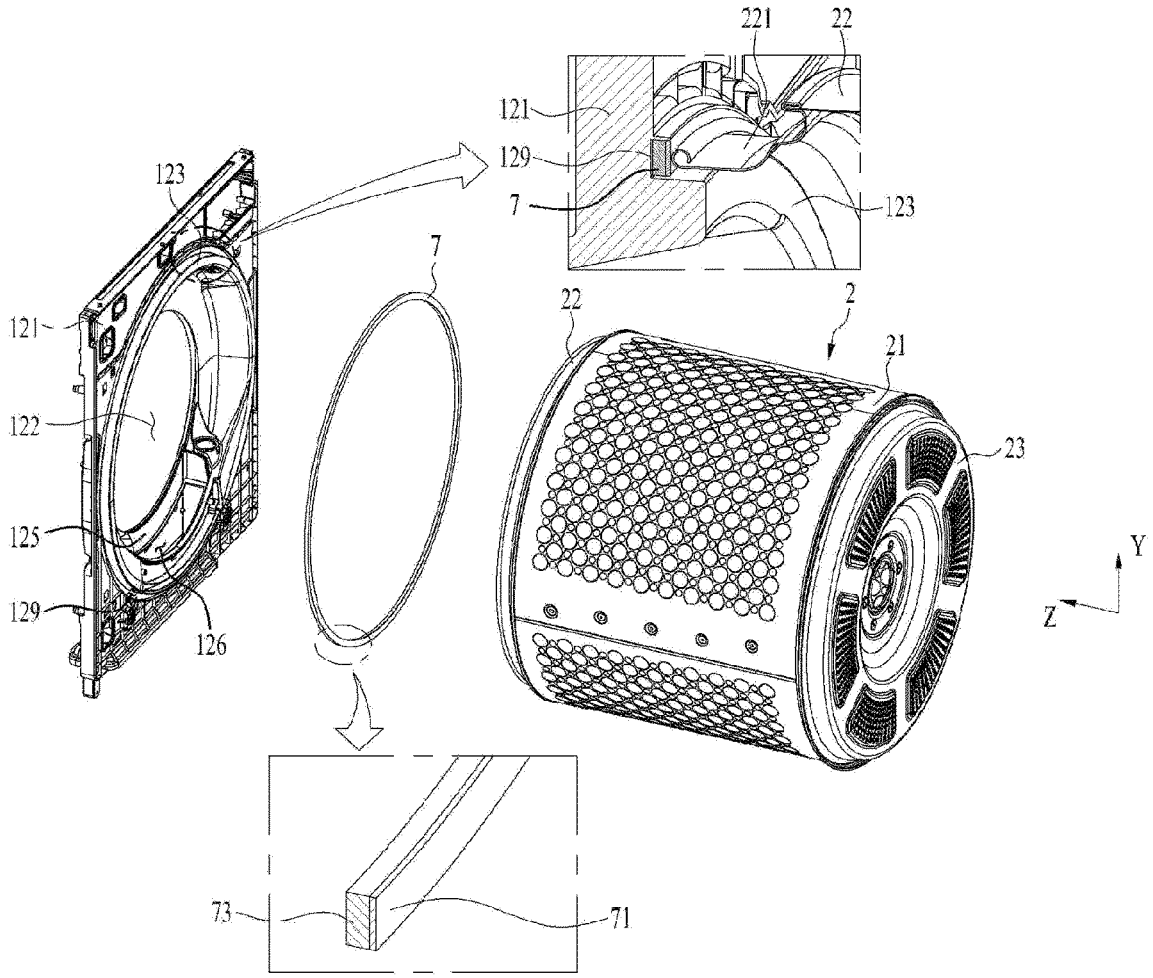
FIG. 12 shows an example of a seal.

As shown in FIG. 12, the seal 7 may be disposed on the support panel 121.

The support panel 121 may have a ring-shaped mounting groove 129 surrounding the drum connecting body 123, and the seal 7 may be disposed in the mounting groove 129. That is, the seal 7 may be formed as a ring-shaped sealing body 71 that is fixed to the mounting groove 129 and is in contact with an edge of the drum inlet 221.

The sealing body 71 may be made of felt (compressed fiber or the like). This is to seal the drum inlet 221, and at the same time, minimize a friction between the drum and the sealing body 71.

In one example, to attenuate vibration of the drum 2 when the drum 2 vibrates along a longitudinal direction of the cabinet (a Z-axis direction), a damper 73 may be further disposed in the mounting groove 129. The damper 73 may be made of a material with high elasticity such as rubber, and may be formed in a ring shape. In this case, the sealing body 71 will have to be fixed to the damper 73.

In the laundry treating apparatus 100 having the above-described structure, the drum inlet 221 may vibrate along a radial direction of the inlet 122 when the drum 2 rotates. To limit a vibration range of the drum inlet 221 in the radial direction of the inlet, the laundry treating apparatus 100 may further include a displacement limiter.

Figure 13:
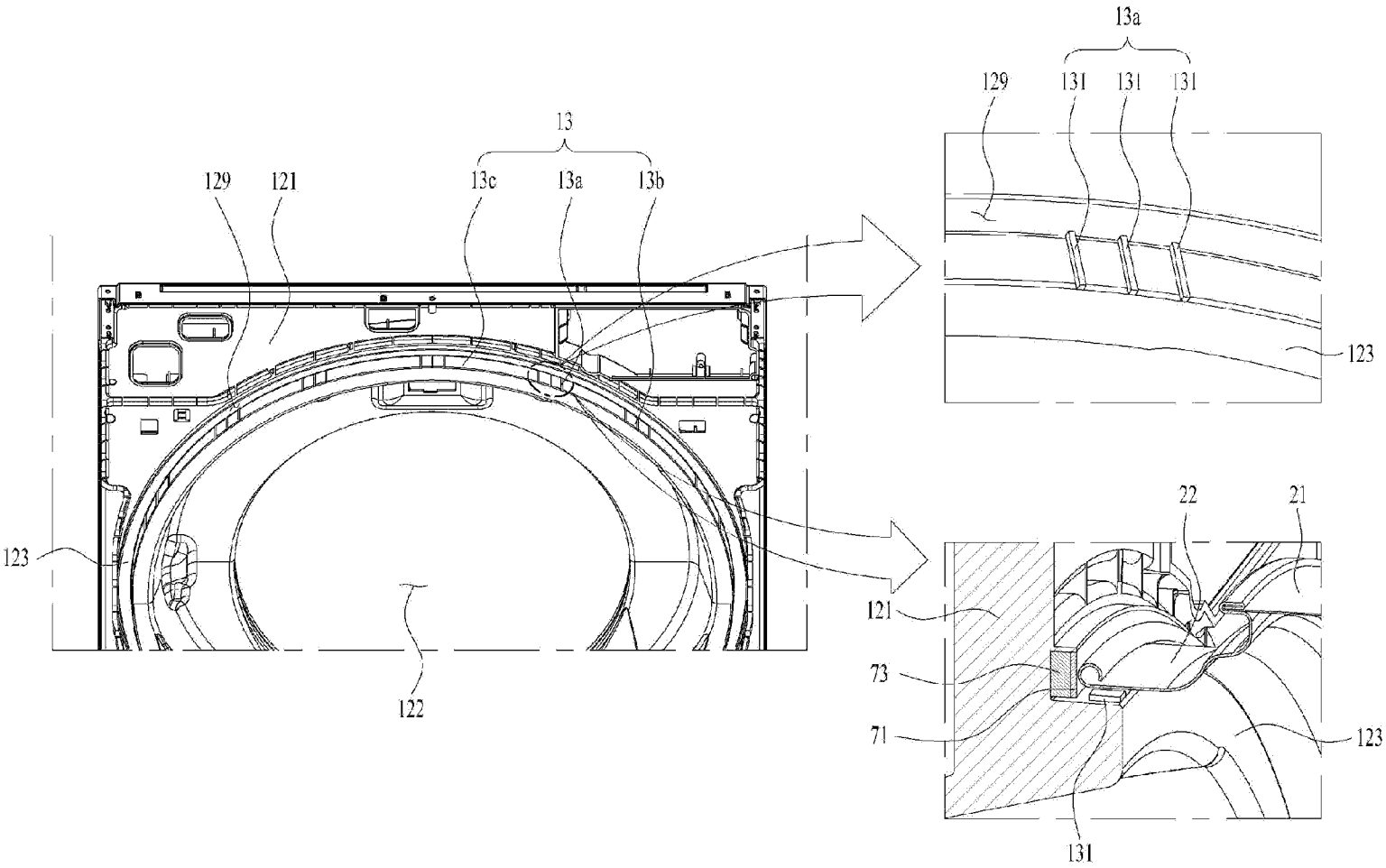
FIGS. 13 and 14 show embodiments of a displacement limiter that limits a displacement of a drum inlet.

As shown in FIG. 13, a displacement limiter 13 may be formed as a protrusion 131 protruding from the drum connecting body 123 toward the drum inlet 221. Although not shown in the drawing, the displacement limiter 13 may be disposed on the front cover 22. That is, the displacement limiter may be formed as a protrusion protruding from the drum inlet 221 toward the drum connecting body 123.

The displacement limiter 13 may include multiple displacement limiters. That is, the displacement limiter 13 may include multiple limiters 13*a*, 13*b*, and 13*c* spaced apart from each other at the same angle around the inlet 122.

Although not shown in the drawing, the displacement limiter may be composed of a first limiter and a second limiter spaced apart from each other by 180 degrees around the inlet 122, or may be composed of the first limiter, the second limiter, and a third limiter spaced apart from each other by 120 degrees around the inlet 122.

In any case, it is preferable that one of the multiple limiters 13*a*, 13*b*, and 13*c* is disposed at a location in contact with an uppermost end of the drum inlet 221. When the output shaft 65 is disposed parallel to the base 17, the front cover will sag toward the base 17 because of a self-weight thereof. Therefore, when one of the multiple limiters is disposed as described above, a displacement of the drum inlet resulted from the sagging of the drum may be minimized.

When the displacement limiter 13 is formed as the protrusion 131 disposed on the support panel 121, a material of the protrusion 131 is preferably set to be equal to a material of the support panel 121. This is to ensure ease of manufacturing.

In addition, to minimize friction caused by the displacement limiter 13, it is preferable that the front cover 22 is made of a metal and the displacement limiter 13 is made of a material (plastic or the like) with a hardness lower than that of the front cover 22.

Figure 14:
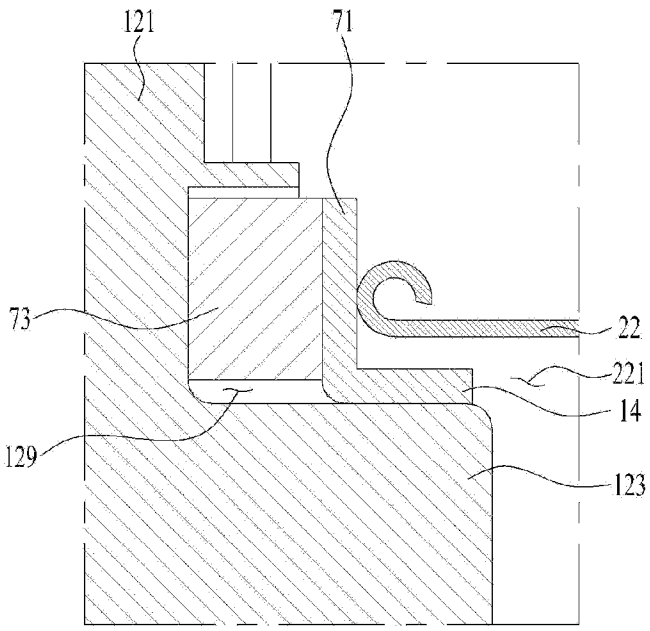
Figure 14:
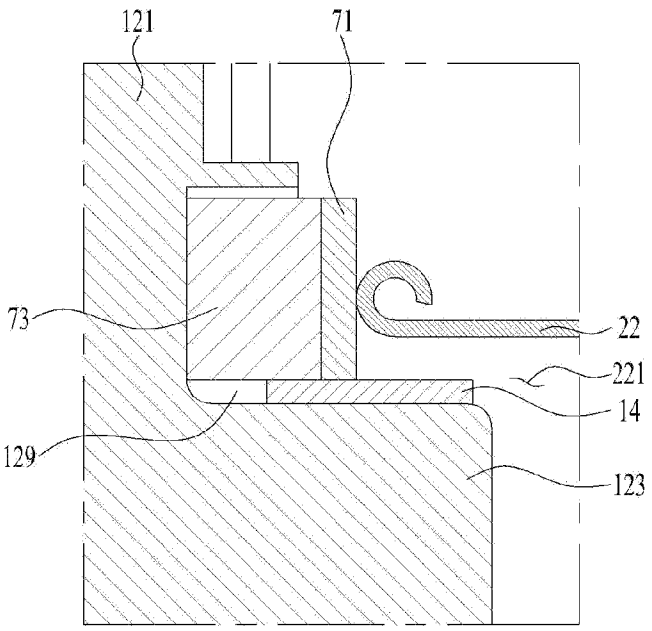

FIG. 14 shows a case in which a displacement limiter 14 is formed as a ring-shaped felt fixed to the drum connecting body 123. That is, the displacement limiter 14 according to the present embodiment is characterized in that the felt is fixed to the drum connecting body 123 and is located between a circumferential surface of the drum connecting body 123 and the drum inlet 221.

The displacement limiter 14 may be formed as a lower end of the sealing body 71 is bent, or may be formed as a separate felt separated from the sealing body 71 is located at the lower end of the sealing body 71.

The laundry treating apparatus described above may be modified and implemented in various forms, so that the scope of rights of the present disclosure is not limited to the above-described embodiments.

The invention claimed is:

1. A laundry treating apparatus comprising:

a drum including a drum body providing a space for storing laundry therein, a front cover forming a front surface of the drum body, a rear cover forming a rear surface of the drum body, and a rear cover through-hole defined to extend through the rear cover;

a fixed panel disposed at a location spaced apart from the rear cover;

a power transmitter including a housing fixed to the fixed panel, an input shaft with one end located outside the housing and the other end located inside the housing, an output shaft with one end extending through the fixed panel and fixed to the rear cover and the other end located inside the housing, and a gear unit located inside the housing and configured to transmit a rotating motion of the input shaft to the output shaft;

a motor including a stator fixed to the fixed panel or the housing and configured to generate a rotating magnetic field, and a rotor where the one end of the input shaft is fixed and rotated by the rotating magnetic field;

a support panel disposed at a location spaced apart from the front cover;

an inlet defined to extend through the support panel;

a drum connecting body protruding from the support panel toward the front cover, inserted into a drum inlet, and surrounding the inlet; and a displacement limiter disposed on the drum connecting body and configured to limit a displacement of the drum inlet with respect to a radial direction of the inlet.

2. The laundry treating apparatus of claim 1, wherein the displacement limiter is formed as a protrusion protruding from the drum connecting body toward the drum inlet.

3. The laundry treating apparatus of claim 2, wherein the displacement limiter includes a first limiter and a second limiter spaced apart from each other by 180 degrees around the inlet.

4. The laundry treating apparatus of claim 2, wherein the displacement limiter includes a first limiter, a second limiter, and a third limiter spaced apart from each other by 120 degrees around the inlet.

5. The laundry treating apparatus of claim 4, wherein one of the first limiter, the second limiter, and the third limiter is disposed to be in contact with an uppermost end of the drum inlet.

6. The laundry treating apparatus of claim 5, wherein the first limiter, the second limiter, and the third limiter are made of the same material as the support panel.

7. The laundry treating apparatus of claim 6, wherein the front cover is made of metal, and the displacement limiter is made of a material with a hardness lower than a hardness of the front cover.

8. The laundry treating apparatus of claim 1, wherein the displacement limiter is formed as a protrusion protruding from the drum inlet toward the drum connecting body.

9. The laundry treating apparatus of claim 1, further comprising:

a mounting groove defined in the support panel and defined as a ring-shaped groove surrounding the drum connecting body; and a seal disposed in the mounting groove and in contact with an edge of the drum inlet.

10. The laundry treating apparatus of claim 9, wherein the seal includes:

a damper fixed to the mounting groove; and a ring-shaped sealing body fixed to the damper and in contact with the edge of the drum inlet.

11. The laundry treating apparatus of claim 10, wherein the displacement limiter is formed as a felt fixed to the drum connecting body and located between a circumferential surface of the drum connecting body and the drum inlet.

12. The laundry treating apparatus of claim 11, wherein the sealing body and the displacement limiter are made of the same material.

* * * * *